US005393961A

United States Patent [19]

Umekage et al.

[11] Patent Number: 5,393,961

[45] Date of Patent: Feb. 28, 1995

[54] AIR COOLING FAN ARRANGEMENT IN A MICROWAVE HEATING DEVICE

[75] Inventors: Yasuhiro Umekage, Kurita; Shinichi Sakai, Nara; Yoshiaki Watanabe, Yamatokooriyama; Hisashi Morikawa, Kitakatsuragi; Makoto Mihara, Nara, all of Japan

[73] Assignee: Matsushita Electric Industrial Co., Ltd., Osaka, Japan

[21] Appl. No.: 69,519

[22] Filed: Jun. 1, 1993

[30] Foreign Application Priority Data

Jun. 1, 1992 [JP] Japan ..... 4-139563
Jun. 1, 1992 [JP] Japan ..... 4-139568
Jul. 2, 1992 [JP] Japan ..... 4-175192

[51] Int. Cl.[6] ..... H05B 6/64
[52] U.S. Cl. ..... 219/757
[58] Field of Search ..... 219/10.55 R, 10.55 B, 219/10.55 E, 757; 126/21 A; 361/384

[56] References Cited

U.S. PATENT DOCUMENTS 4,100,463 7/1978 Sugie ..... 219/10.55 R
4,546,225 10/1985 McCammon ..... 219/10.55 R
4,623,771 11/1986 Sakino ..... 219/10.55 B
4,743,728 5/1988 Nagafusa et al. ..... 219/10.55 E
4,812,617 3/1989 Takeuji ..... 219/10.55 R

FOREIGN PATENT DOCUMENTS

0477633A1 9/1991 European Pat. Off. .
4-55621 2/1992 Japan .

*Primary Examiner*—Bruce A. Reynolds
*Attorney, Agent, or Firm*—Wenderoth, Lind & Ponack

[57] ABSTRACT

In a microwave heating device, a propeller fan is mounted on a drive shaft of a motor that in vertically positioned parts of a high frequency power supply unit are arranged in the order of a power control semiconductor device and a high-voltage transformer along the direction of revolution of the propeller fan. The motor is secured to a support member formed by a motor cover attached to the casing of the propeller fan. The fan and high frequency power supply unit are mounted to a first frame and a second frame, both of which are bent and connected at a connecting portion and fixed in an approximately "L" shape, while an airflow path is defined by a first guide wall and a second guide wall to cool the parts of the high frequency power supply unit. An airflow path is formed by a plurality of guide walls provided on the two frames, and a communicating hole is provided in proximity to the connecting portion of the two frames. The propeller fan is so arranged as to revolve at a low r.p.m. after stopping the microwave heating.

5 Claims, 11 Drawing Sheets

AIR COOLING FAN ARRANGEMENT IN A MICROWAVE HEATING DEVICE

BACKGROUND OF THE INVENTION

1. Field of the Invention

The present invention relates to a microwave heating device for heating and preparing items and material subject to cooking and the like.

2. Description of the Prior Art

There is known a conventional microwave heating device is disclosed, for example, in Japanese Patent Laid-Open Unexamined Publication No. 55621/1992. The construction of this conventional heating device will be described below with reference to FIG. 1.

As shown in FIG. 1, the conventional heating device is provided with a heating chamber 1 in which an object or cooking material or the like is heated by the application of microwave energy. A magnetron 2 which generates microwave energy to the heating chamber 1, a high frequency power supply unit 3, such as an inverter power supply unit, supplies high voltage electric power to the magnetron 2, a propeller fan 4 is rotated by a motor for cooling the magnetron 2 and the high frequency power supply unit 3, and a control unit 5 controls the high frequency power supply unit 3 and the propeller fan 4. The heating device is further provided with a vent hole 7 formed in its bottom face 6, so that the propeller fan 4 sucks cooling air through the vent hole 7 to cool the magnetron 2 and the high frequency power supply unit 3.

However, in the above conventional configuration, the space between the bottom face 6 and a floor 9 is generally made small for saving the installation space of the microwave heating device and for reducing the noise derived from the fan. Therefore, the cooling air sucked from the narrow space through the vent hole 7 may be insufficient in amount. This would account for the great difficulty in cooling the high frequency power supply unit 3 and the magnetron 2.

In particular, the high frequency power supply unit 3 includes high-voltage parts, so appropriate electrical insulation is required in determining the arrangement of the component parts, and there is a problem in that the positioning of the parts can not be determined from primarily considering the standpoint of cooling. Thus, it has been difficult to achieve an efficient cooling performance of the parts. For this reason, a guide plate 8 or the like is provided to direct the cooling air to the magnetron 2, otherwise the rotating speed (r.p.m.) of the propeller fan 4 is increased to increase the supply amount of cooling air, thereby ensuring the cooling performance. As a result, there is a problem that the cooling air path becomes large and complex while the propeller fan 4 makes a very great noise during operation, generating great noise in the kitchen.

Also, since a propeller fan is installed in the lower portion of the device below the magnetron and the high frequency power supply unit, there is a problem in that the motor may be damaged by chips that are produced when installing parts during the assembly process and by waterdrops produced when water vapor leaking from the heating chamber 1 during the microwave heating process condenses in the magnetron.

SUMMARY OF THE INVENTION

In order to solve the problems mentioned above, the present invention has been developed, having an essential objective of providing a microwave heating device which comprises a heating chamber in which an object or material be heated is heated by the application of microwave energy a microwave radiating means for radiating microwave energy to the object material to be heated, a high frequency power supply means for supplying high frequency electric power to the microwave radiating means, the high frequency power supply means being positioned in proximity to as well as in parallel to the microwave radiating means and perpendicular to a surrounding side wall of the heating chamber, an air feeding means installed in the lowermost portion of a mechanical chamber for feeding cooling air, which forms a cooling air flow from the lower part through an air suction port formed in a bottom wall of the mechanical chamber to cool the microwave radiating means and high frequency power supply means, and a control means for controlling the high frequency power supply means and air feeding means.

Parts of the high frequency power supply means are disposed in proximity to the air feeding means in the cooling air flow.

The microwave radiating means is composed of a magnetron and the air feeding means is composed of a propeller fan having a rotation axis in the vertical direction which is driven by a motor.

The high frequency power supply means includes a power control semiconductor device and a high-voltage transformer which are disposed in the cooling air flow, in this order, along the direction of revolution of the propeller fan.

According to another feature of the present invention, the microwave heating device further comprises a first frame having a first guide wall in which the air feeding means is securely fixed in a casing and a second frame having a second guide wall on which the high frequency power supply means is mounted. The first frame and second frame are bent at a connecting portion and fixed in an approximately L shape, wherein an airflow path is defined by the first and second guide walls to flow cooling air for cooling the parts of the microwave power supply means.

According to another feature of the present invention, the first guide wall is formed by extending a part of the casing of the air feeding means to have its height approximately equal to the level of the height of the power control semiconductor device and the high-voltage transformer, the top portion of the first guide wall being in proximity to a cooling path of the microwave radiating means, and the second guide wall being formed in proximity to the first guide wall so as to surround the power control semiconductor device and the high-voltage transformer.

By this arrangement, a cooling air path is defined to positively feed cooling air to the magnetron, while on the high frequency power supply circuit board there are provided a power control semiconductor of smaller calorific value and a high-voltage transformer of greater calorific value disposed in this order along the direction of the spinning stream or air in proximity to the propeller fan, thereby the cooling efficiency of the parts of the microwave power supply unit is improved, so that the cooling operation can be accomplished with a smaller amount of air. By this arrangement the cooling air path can be compacted so that the parts can be cooled with high efficiency. Moreover, it becomes possible to lower the r.p.m. of the fan motor, and as a result, the noise generated from the air flow can be reduced.

Further, the motor is protected by overlapping a motor cover, which also serves as part of a motor support member, and a boss of an impeller with each other in a double structure above the fan motor. By this arrangement, the motor, when used in the vertical direction, can be prevented from damage due to anything dropping from above.

Furthermore, since the first and second frames are bent at a connecting portion and connected to each other so as to be fixed in an approximately L-shape, the positioning of the propeller fan and the parts of the high frequency power supply unit can be fixed with high accuracy, allowing the parts of the microwave power supply circuit to be located in close proximity to the propeller fan. Accordingly, cooling air of a very high flow rate can be applied to the parts of the high frequency power supply circuit, greatly facilitating the cooling of the parts.

Further, by arranging the first guide wall, provided on the first frame, and the second guide wall, provided on the second frame over the range of height from the propeller fan to the power control semiconductor and the high-voltage transformer, the spinning stream of cooling air can be generated along the direction of revolution of the propeller fan on its downstream side. Accordingly, the power control semiconductor and the high-voltage transformer, arranged along the spinning stream, can be cooled with a high efficiency, and by disposing these parts in proximity to the propeller fan, the high frequency power supply circuit can be reduced in height, thus allowing the whole system to be reduced in size.

Furthermore, the fan motor is so arranged as to blast cooling air at a specified r.p.m., and moreover to be lowered in its r.p.m., after the microwave heating is stopped, thus facilitating the cooling of the parts quietly. In this way, lowering the r.p.m. of the fan motor causes the noise level to change, making it known by auditory sense that the microwave heating has stopped. That also allows the parts to be further cooled after the microwave heating has stopped, whereby the microwave heating device can be used in intermittent operation.

BRIEF DESCRIPTION OF THE DRAWINGS

The above and other objects and features of the present invention will become apparent from the following description, taken in conjunction with preferred embodiment thereof and with reference to the accompanying drawings, in which.

DETAILED DESCRIPTION OF THE PREFERRED EMBODIMENTS

The following describes preferred embodiments of the present invention with reference to FIGS. 2 through 12.

EXAMPLE 1

First, a microwave heating device according to a first aspect of the invention is described with reference to FIGS. 2 through 5.

Figure 2:
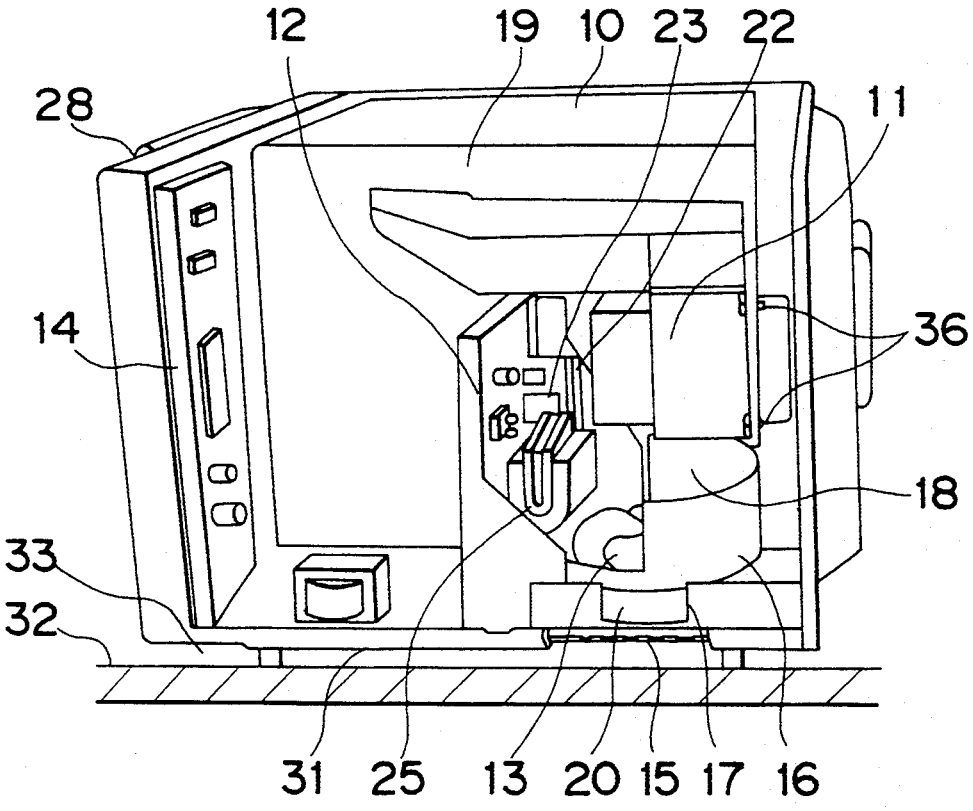
FIG. 2 is a side view in section of a microwave heating device according to an embodiment of the present invention.
Figure 3:
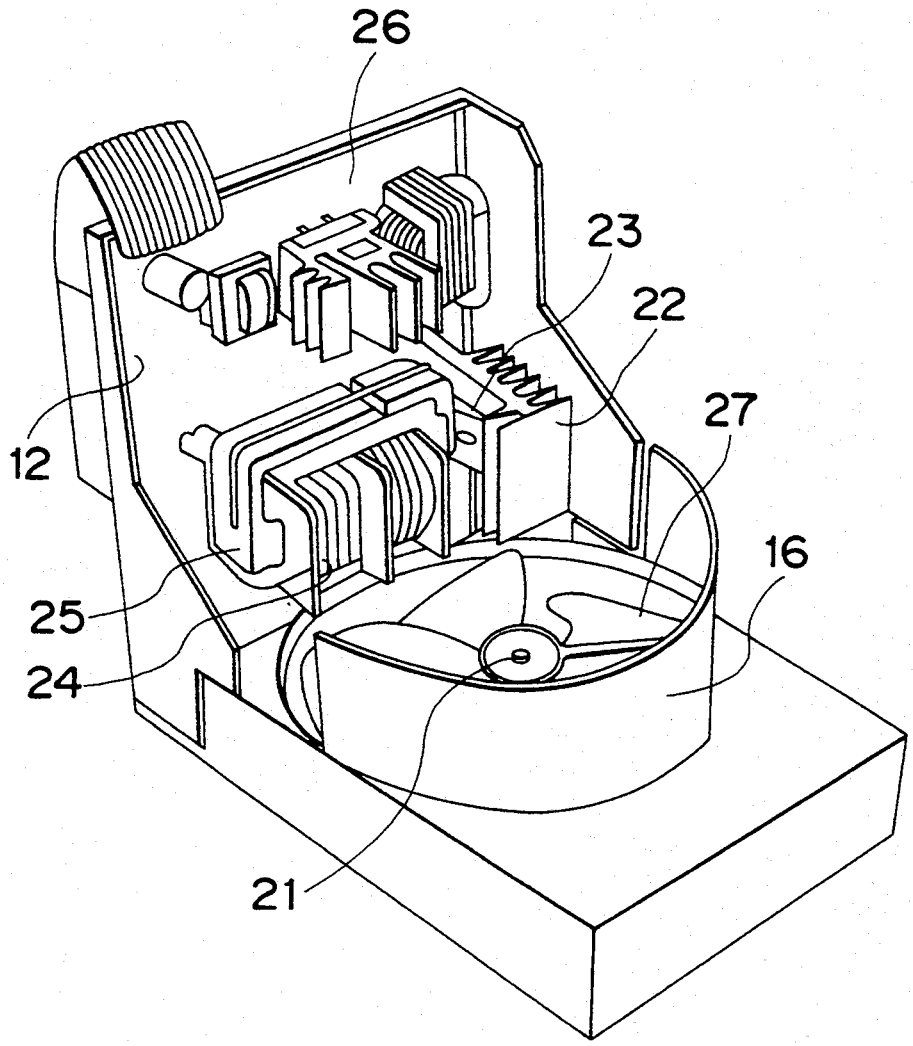
FIG. 3 is a perspective view of a fan and a microwave power supply unit of the device of FIG. 2.

Referring to FIGS. 2 and 3, reference numeral 10 denotes a heating chamber for heating an object cooking material or the like to be heated disposed therein. High frequency power supply unit 12 supplies a magnetron 11 with high voltage power, and microwave energy generated by the magnetron 11 is fed to the heating chamber 10. Reference numeral 13 denotes a propeller cooling fan for feeding cooling air to the magnetron 11 and the high frequency power supply unit 12. The microwave heating device is further provided with a control unit 14 for controlling the magnetron 11, the high frequency power supply unit 12 and the propeller cooling fan 13. An air suction port 15 for sucking cooling air is formed in a specified area of a bottom face 31, so that the propeller fan 13 sucks air into the chamber 10 through the air suction port to cool the magnetron 11 and the high frequency power supply unit 12.

Reference numeral 16 denotes a guide wall formed by extending a casing member 17 surrounding the propeller fan 13 toward the downstream side of the flow of the cooling air. Reference numeral 18 denotes a mechanical chamber for accommodating the magnetron 11, the high frequency power supply unit 12, and the propeller fan 13.

In this arrangement, the high frequency power supply unit 12 is vertically installed in proximity to the magnetron 11 and perpendicularly to a vertical side wall 19 of the heating chamber 10, while the propeller fan 13 is mounted on a drive shaft 21 of a motor 20 disposed in the vertical direction below the magnetron 11 and the high frequency power supply circuit 12. Further, in this example, the motor 20 for driving the propeller fan 13 is so arranged as to revolve the fan 13 counterclockwise when viewed from the top, and the parts in the high frequency power supply unit 12 are positioned in such a manner that a power transistor 23, which is composed of a power control semiconductor attached Go radiation fins 22, and a high-voltage transformer 25 with its coil 24 opposed to the propeller fan 13, are disposed in this order along the direction of the spinning stream of the cooling air supplied by the revolution of the propeller fan 13. The power transistor 23 and the high-voltage transformer 25 are located at the lowest end portion of a high frequency power supply unit board 26 so that the power transistor 23 and the high-voltage transformer 25 are closest to the propeller fan 13.

In the above described arrangement, the magnetron 11 is cooled in an air-flow path which is defined by the first guide wall 16 formed by extending a part of the casing 17 of the propeller fan 13, and the board 26 of the high frequency power supply unit 12, so that the magnetron 11 is efficiently cooled in the mechanical chamber 18, which has a small space, without any excessive parts such as a guide wing.

Since the air flow in proximity to an impeller 27 of the propeller fan 13 spins in the direction of revolution of the impeller 27, the parts to be cooled are disposed in order from the power transistor 23 to the high-voltage transformer 25 along the direction of the revolution of the impeller, i.e. the direction of the spinning stream of cooling air fed by the propeller fan 13, thus achieving efficient cooling performance. In other words, as compared with the case where the power transistor 23 is cooled by the air after the air has served to cool the high-voltage transformer 25 of large size and high temperature, with a large heat capacity, a more efficient cooling can be attained when the power transistor 23 of small heat capacity and low temperature is located on the upstream and cooled first before cooling the high-voltage transformer 25.

Figure 4:
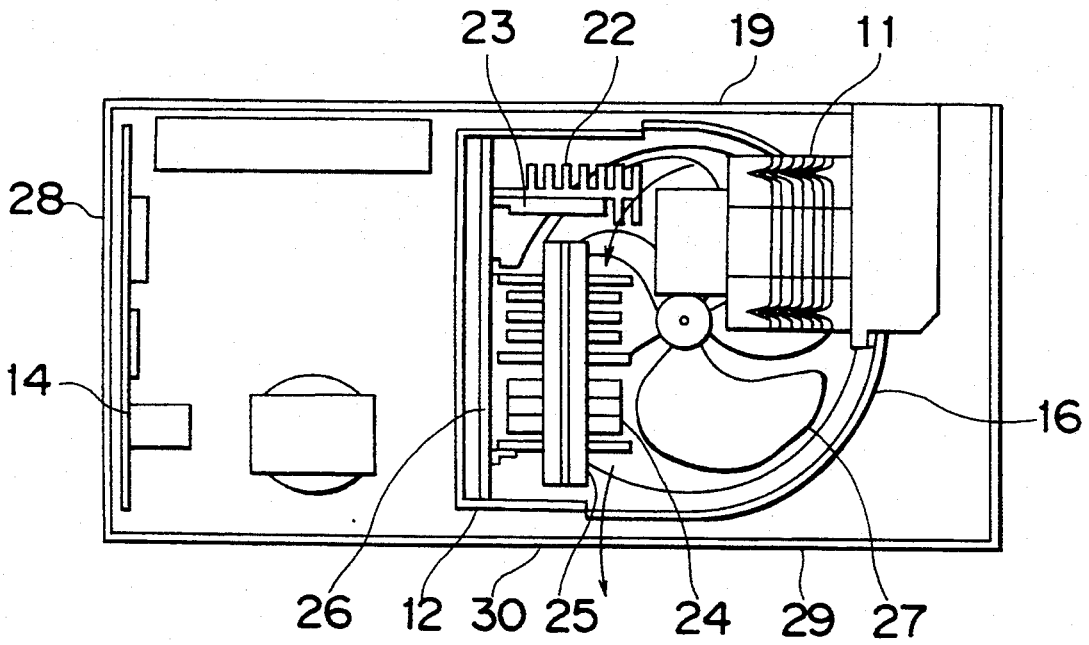
FIG. 4 is a top plan view of a mechanical chamber of the same device.

Yet, since the spinning stream of the air flowing along the high frequency power supply circuit 12 is partially directed from the side wall 19 of the heating chamber 10 toward a side face 29 of a housing 28 of the microwave heating device, as indicated by the arrows in FIG. 4, the spinning stream of air is therefore exhausted outside the housing 28 through an exhaust vent hole 30 formed in the side face 29 as shown in FIG. 4. Therefore, since the cooling air will not circulate within the mechanical chamber 18, efficient cooling is achieved. Besides with respect to the high-voltage transformer 25, when the coil 24 to be cooled is opposed and the propeller fan 13 to brought into contact with the air flow, the cooling effect is further enhanced.

By the arrangement as described above, even if the revolution speed (r.p.m.) of the propeller fan 13 is lowered, the required cooling ability can be achieved, resulting in that the noise of the heating device in operation can be reduced. Further, the noise due to air flow is radiated primarily to the outside of the housing 28 through the suction port 15, and since the noise due to air flow is radiated to the kitchen through a narrow space 33 defined by a housing bottom plate 31 and a base 32, the noise is largely decreased, so that the device can be even lower in noise generation.

EXAMPLE 2

Next, the microwave heating device according to a second aspect of the present invention is described with reference to FIGS. 2, 5, and 6. It is to be noted here that like parts having the same construction and serving for the same function as in the first example are designated by the same reference numerals, while their detailed explanation is omitted, and parts different from the first example are primarily described below.

Figure 5:
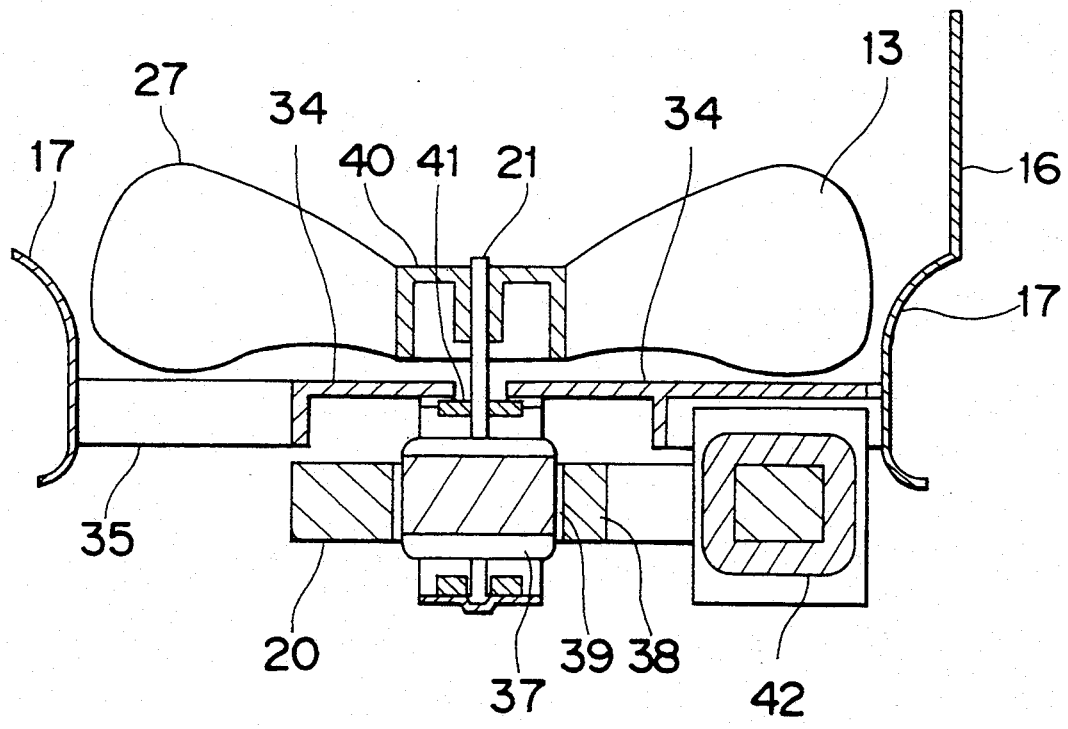
FIG. 5 is a side view in section of a part of the same device where a motor is mounted.
Figure 6:
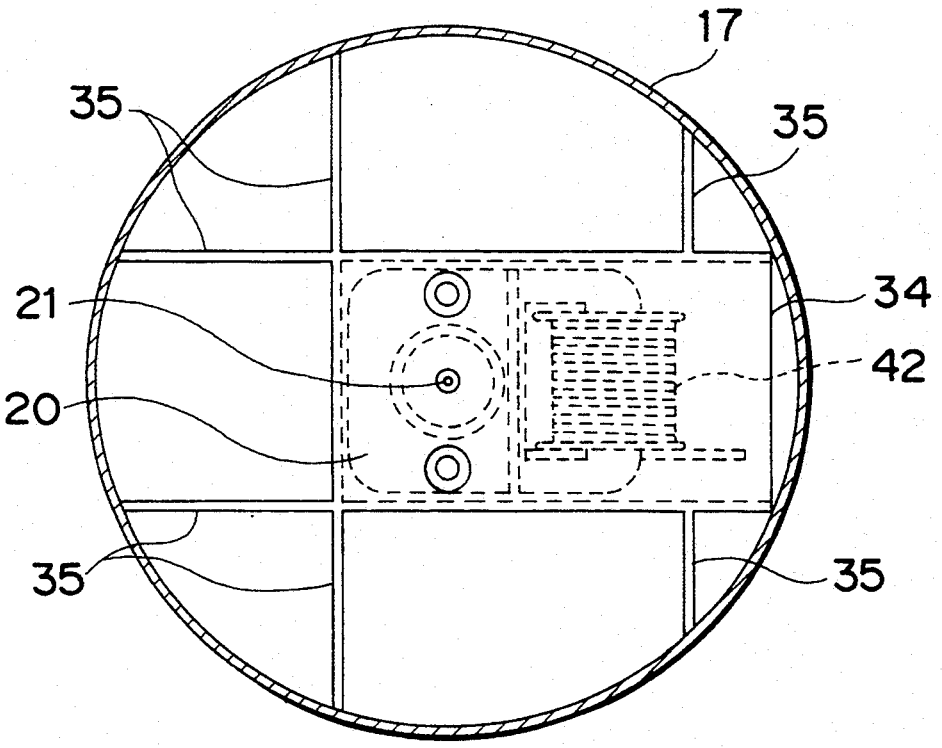
FIG. 6 is a plan view of the part of the same device where the motor is mounted.

As shown in FIGS. 5 and 6, a support member 35, implemented by a motor cover 34, is held by a casing 17 of the propeller fan 13, and the motor 20 is secured to the support member 35.

By this arrangement, even if metal chips and the like have dropped, which are possibly generated in tightening screws 36 (shown in FIG. 2) for securing a magnetron 11 or the like, or even if waterdrops have dropped, which are possibly generated due to condensation of water vapor leaking from a heating chamber during heating operation by the magnetron 11, the metal chips and waterdrops can be prevented from dropping into a clearance 39 between a rotor 37 and a stator 38 of the motor 20, or upon a coil 42. In other words, the motor 20 is so constructed that a boss member 40 of an impeller 27 and a motor cover 34 are overlapped with each other so as to cover both a bearing 41 and the clearance 39, while the motor coil 42 is covered by the motor cover 34.

By this double covering structure, even when a motor is used in the vertical direction, the motor can be prevented from contamination by waterdrops and the like which may drop from above the motor 2. Thus the magnetron 11 can be located above the propeller fan 13, while preventing faults, such as a locking phenomenon due to contamination or damage of the coil due to water.

Next, microwave heating devices according to other aspects of the present invention are described with reference to FIGS. 7 through 10. Like parts having the same construction and serving for the same function as in the foregoing examples are designated by the same reference numerals, their detailed explanation being omitted, and unlike parts are primarily described below.

EXAMPLE 3

Figure 7:
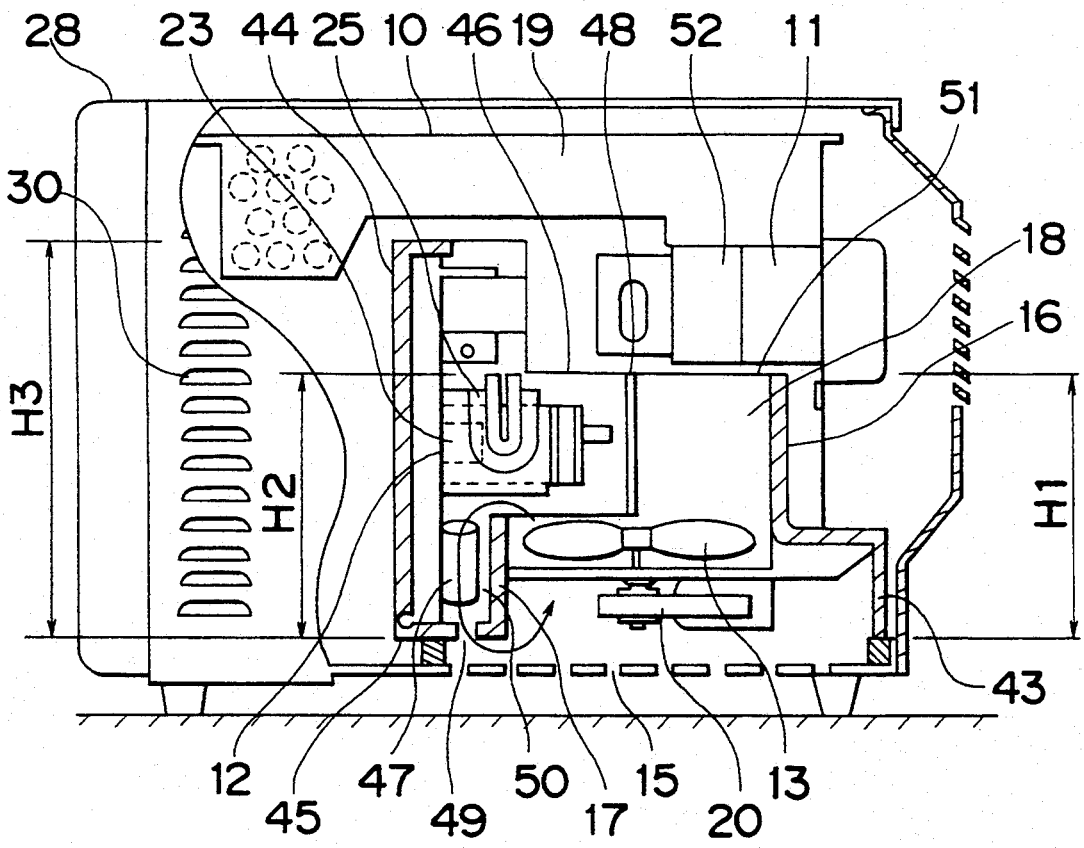
FIG. 7 is a side view in section of a microwave heating device according to another embodiment of the present invention.
Figure 8:
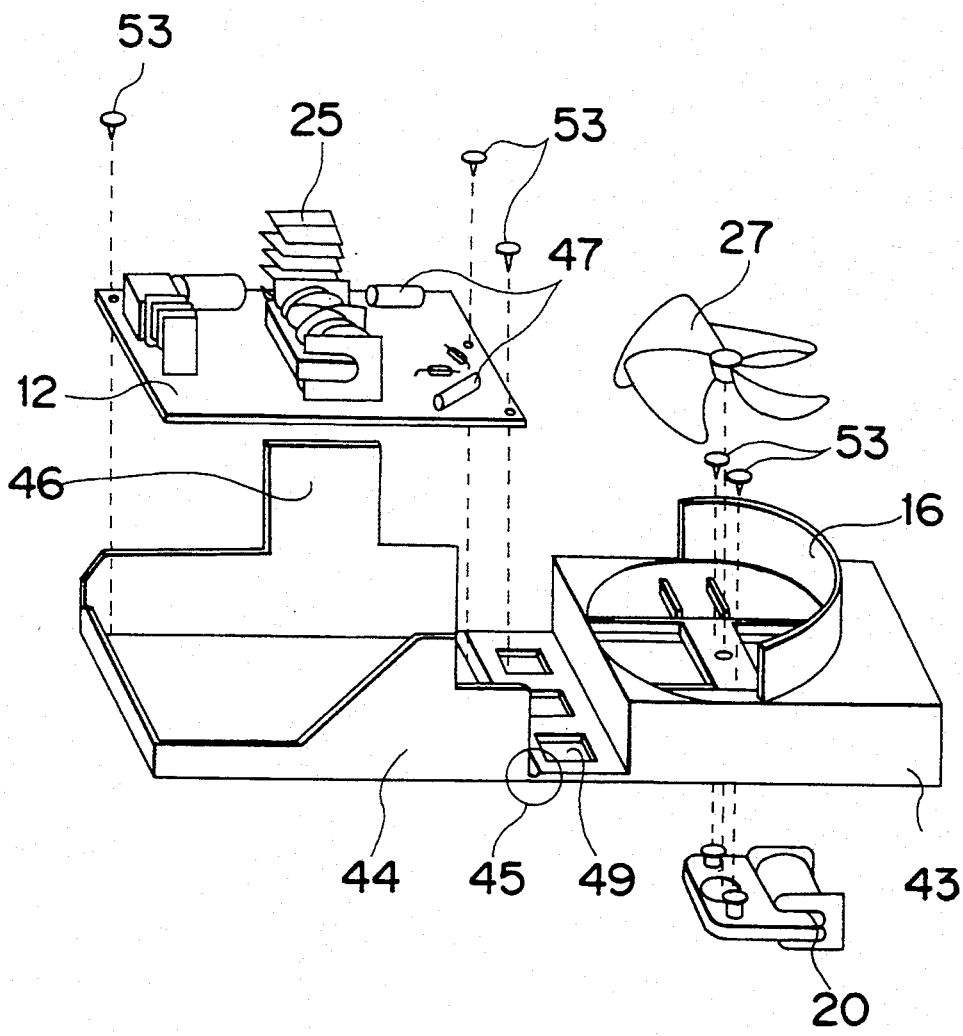
FIG. 8 is an assembly diagram of parts on a frame of the device of FIG. 7.

As shown in FIG. 7, a microwave heating device is provided with a first frame 43 having a propeller fan 13 installed therein, and a second frame 44 having a high frequency power supply unit 12 installed therein. The first frame 43 and the second frame 44 are bent and connected to each other at a connecting portion 45 and fixed in an approximately L-shape. Since the installation work of the motor 20 and the impeller 27, which constitute the propeller fan 13, and the high frequency power supply unit 12, is carried out while the first frame 43 and the second frame 44 are both opened as shown in FIG. 8, the parts can be simply fixed in position with high accuracy, allowing the parts of the high frequency power supply unit 12 to be located in close proximity to the propeller fan 13. As a result, cooling air of a higher flow rate can be applied to the parts of the high frequency power supply unit 12, facilitating the cooling of the parts to a great extent.

In this arrangement, the height H1 of a first guide wall 16 vertically extending on the first frame 43 is made coincident with the height of a second guide wall 46 vertically extending on the second frame 44. The height H1 thereof is set higher than the height H2 ranging from the propeller fan 13 to the power transistor 23 and the high-voltage transformer 25, whereby a spinning stream of cooling air along the revolving direction of the propeller fan 13 can be generated in the space in which the parts are cooled on the downstream side of the propeller fan 13. As a result, the power transistor 23 and the high-voltage transformer 25 arrayed along the spinning stream can be cooled efficiently by cooling first the power transistor of a smaller heat generation amount and then the other parts of a larger heat generation amount.

Further, since the power transistor 23 and the high-voltage transformer 25 can be located in proximity to the propeller fan 13, the clearance can be narrowed between the power transistor 23, the high-voltage transformer 25, and the propeller fan 13. Therefore, the overall height H3 of the high frequency power supply unit 12 can be reduced, which allows the device to be compacted.

Besides, since the first guide wall 16 and the second guide wall 46 are assembled in proximity to each other, air leakage through a clearance 48 between the first guide wall 16 and the second guide wall 46 can be prevented, which allows a large amount of cooling air to be applied to the parts to be cooled, and which allows shielding the radiation of the heat from side wall 19 of the heating chamber 10 with the first and second guide walls, where the heat radiation may interrupt the cooling of the parts. As a result, the parts can be cooled with high efficiency.

Furthermore, electronic parts 47 of the high frequency power supply unit 12 are disposed in proximity to the connecting portion 45 of the second frame 44, while one or more communicating holes 49 are provided in proximity to the connecting portion 45 of the first frame 43. By this arrangement, in an airflow path 50 defined by the casing 17 of the propeller fan 13, which forms the first frame 43 and by the second frame 44, there arises an air flow that circulates through the communicating hole 49 (as indicated by the arrow in FIG. 7). This air flow serves to cool the electronic parts 47. As this airflow path 50 is a narrow space defined between the casing 17 and the second frame 44, making the best use of the narrow space to accommodate the small electronic parts 47 therein and to cool them allows the high frequency power supply system to be compacted.

Besides, the top portion 51 of the first guide wall 16 is in close proximity to a cooling path 52 of the magnetron 11. Therefore, cooling air can be suppressed from leaking through the clearance between the first guide wall 16 and the magnetron 11, which allows the spinning stream of the air flowing along the first guide wall 16 to be partially fed into the cooling path 52 of the magnetron 11, facilitating the cooling of the magnetron 11.

Figure 9:
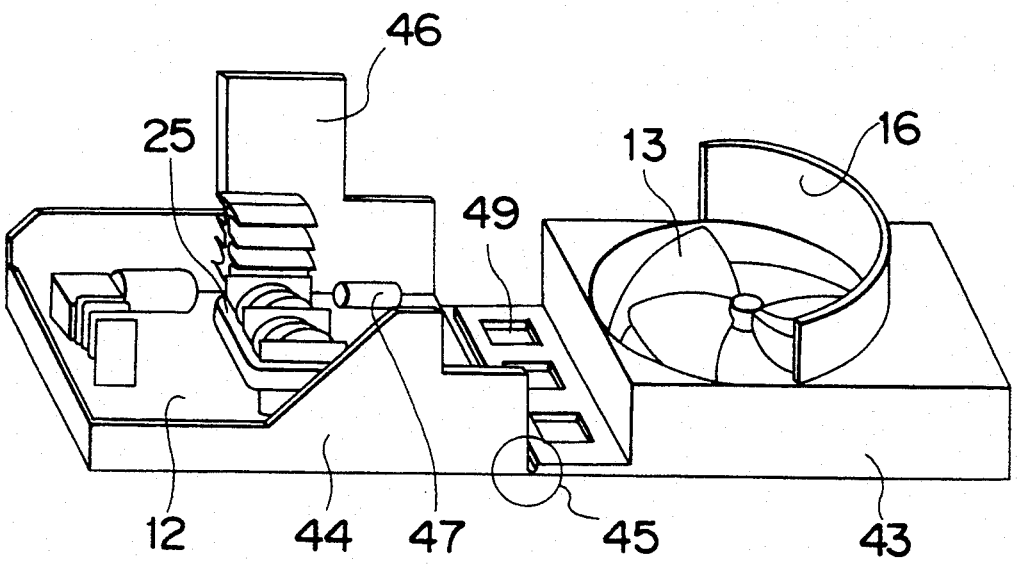
FIG. 9 is a perspective view of a state in which a bent portion of the frame of the same device is opened at a connecting portion thereof.
Figure 10:
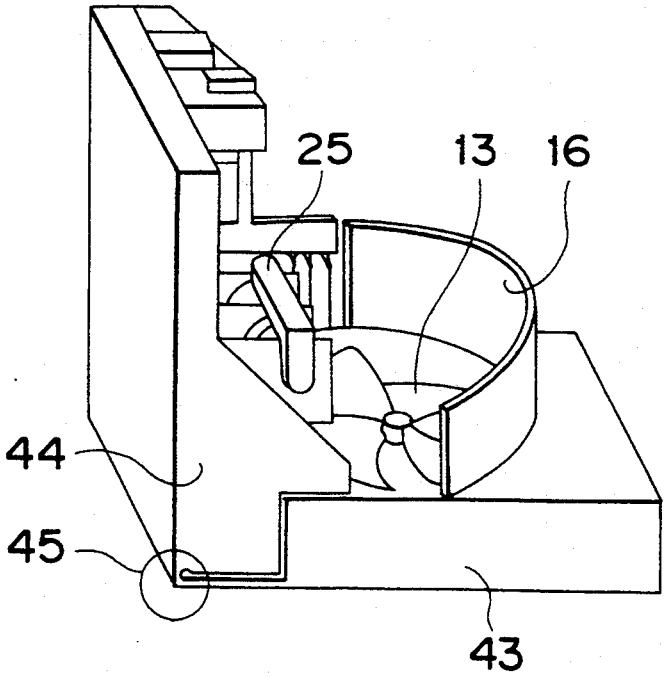
FIG. 10 is a perspective view of a state in which the bent portion of the frame of the same device is fixed at the connecting portion thereof.

Now, the following describes the assembling of these parts of the microwave heating device with reference to FIGS. 8 through 10.

First, as shown in FIG. 8, the propeller fan 13 and the high frequency power supply unit 12 are mounted on the first and second frames 43 and 44, respectively, by means of screws 53 under the condition that the first frame 43 and the second frame 44 are opened. Then, as shown in FIGS. 9 to 10, the first frame 43 and the second frame 44 can be assembled in such a way that the frames 43 and 44 are bent into an L-like character shape by using the connecting portion 45 as a fulcrum and then fixed. The connecting portion 45 is provided by thinning each of the frames in plate thickness at their connecting part.

By such an arrangement and assembling procedure, the assembling of the parts can be carried out in such a wide space that the parts of the high frequency power supply unit 12 and the parts of the propeller fan 13 will not interfere with each other. Besides, since the assembling is accomplished only by tightening in the up and down direction, an automatic assembly using a robot or the like, becomes possible. Moreover, such a high frequency power supply system, offered as a complete set in which the propeller fan 13 and the high frequency power supply unit 12 are assembled with the first and second frames, can be used in a state wherein the cooling system for the parts is completed. Therefore, it can be easily fitted to other microwave heating devices, which will add to the system feature for more comprehensive applications.

Figure 11:
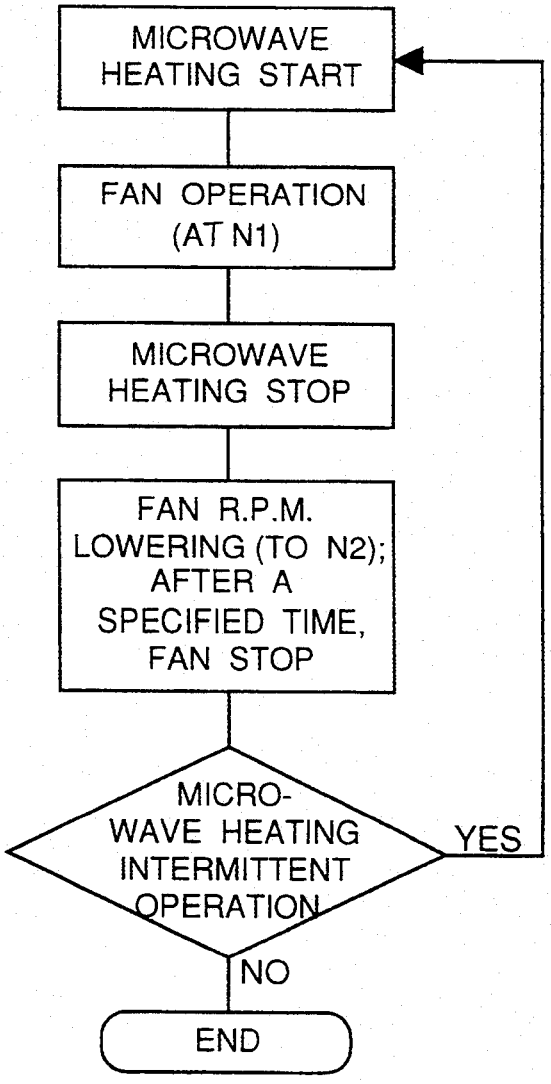
FIG. 11 is a flowchart of motor control in the embodiment of the present invention.
Figure 12:
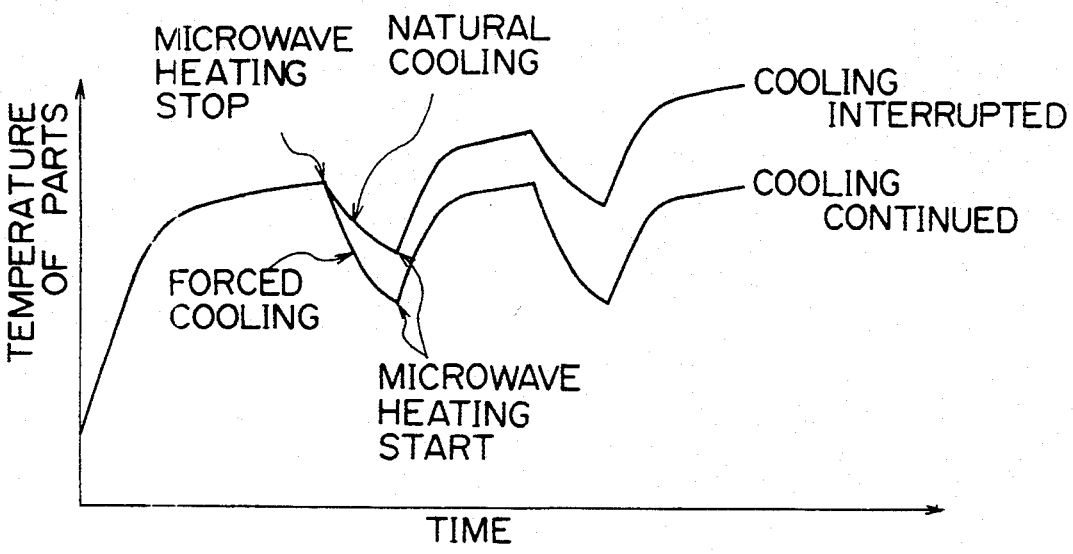
FIG. 12 is a graph showing a temperature variation characteristic of the parts of the device.

Next the following describes the operation of the microwave heating device according to the present invention with reference to FIGS. 11 and 12.

As shown in a flowchart of FIG. 11, the propeller fan is controlled in such a manner that it is operated at a specified r.p.m. N1 during the operation of the high frequency power supply unit, i.e. during the microwave heating process, and after stopping the operation of the high frequency power supply unit (i.e, after stopping the microwave heating), the propeller fan is operated at an r.p.m. N2 lower than the r.p.m. N1, and then the fan is stopped after a specified time elapse. Further, in this example, the r.p.m. of the fan is controlled by wave-number control in which the wave number of the power supply voltage is controlled, but it is not limited to this and also another control system may be applied.

Figure 1:
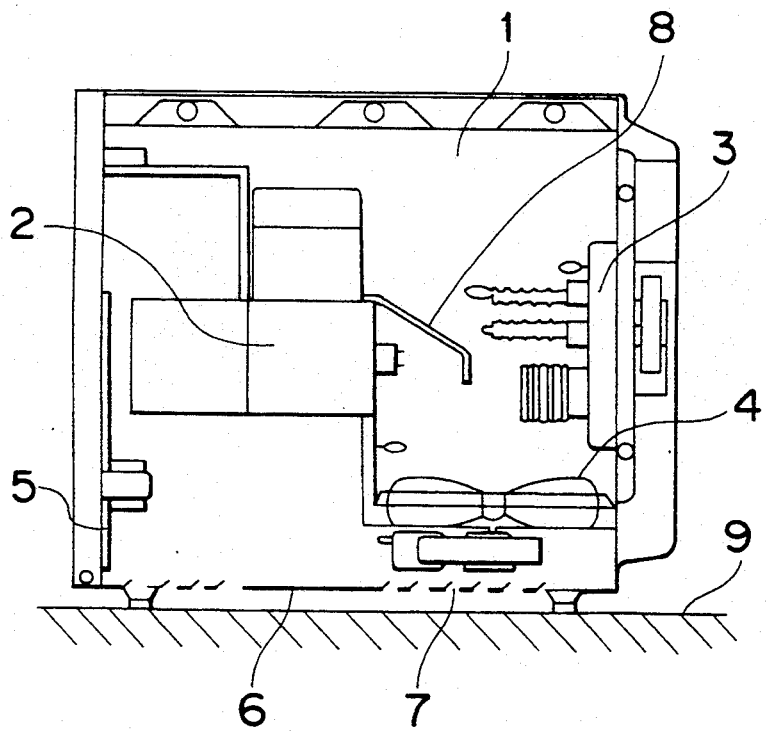
Fig.1 (PRIOR ART)
FIG. 1 is a side view in section of a conventional microwave heating device.

By such an arrangement, even in the present embodiment, in which cooling air is sucked into the heating chamber through the space having a narrow distance between the bottom face 6 of the housing and the floor 9 (see FIG. 1), cooling air can be fed by operating the propeller fan after stopping the drive of the high frequency power supply unit so that the parts can be cooled while suppressing the operational noise. Moreover, stopping the microwave heating can advantageously confirmed with the auditory sense from a change in the operating sound.

Further, if the r.p.m. of the fan is set to a specified member by wave-number control during the rated operation, there can be eliminated variations in the torque performance, depending on the motor or fluctuations in the r.p.m. with fluctuating power supply voltage, so that the propeller fan can be revolved at a constant r.p.m. N1 at all times. As a result, the cooling of the parts can be implemented without fail. Besides, by feeding air with the r.p.m. lowered to N2 after stopping the microwave heating, the cooling of parts can be furthered in a continuous manner while keeping the operational noise suppressed.

Accordingly, as shown in the temperature characteristic of the parts illustrated in FIG. 12, an increase in the temperature of the parts can be suppressed to only a small increase by continuously cooling the parts also after stopping of the microwave heating. As a consequence, the microwave heating device can be operated in intermittent use with less rest time.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A microwave heating device, comprising:

a heating chamber having a side wall;

a mechanical chamber adjacent to said side wall of said heating chamber, said mechanical chamber having a bottom wall with an air suction port therein at a lower part thereof;

a magnetron provided in said mechanical chamber for radiating microwave energy to material to be heated in said heating chamber;

a high frequency power supply adapted to supply microwave electric power to said magnetron, said high frequency power supply being positioned in proximity to and parallel with said magnetron and positioned perpendicular to said side wall of said heating chamber in said mechanical chamber, and said high frequency power supply comprising a power control semiconductor device and a high voltage transformer;

an air feeding device provided in the lower part of said mechanical chamber adapted to form a cooling air flow through said air suction port for cooling said magnetron and said high frequency power supply, said air feeding device comprising a propeller fan driven by a motor, and said propeller fan having a vertical axis of rotation and a direction of rotation;

a control adapted to control said magnetron and said high frequency power supply;

wherein said power control semiconductor device and said high-voltage transformer are disposed in proximity to said air feeding device in the cooling air flow, said power control semiconductor device being positioned first, before said high-voltage transformer, in the direction of rotation of said propeller;

a first frame in said mechanical chamber having a casing member in which said air feeding device is securely fixed and a first guide wall;

a second frame on which said high frequency power supply is disposed and having a second guide wall;

wherein said first and second frames are connected together at a connecting .portion and fixed in an approximate L shape, and wherein said first and second guide walls define an airflow path for the cooling air flow for cooling said high frequency power supply; and at least one communicating hole in said first frame in proximity to said connecting portion for generating an air flow circulating therethrough for cooling parts of said high frequency power supply disposed in proximity to said connecting portion.

2. A microwave heating device, comprising:

a heating chamber having a side wall;

a mechanical chamber adjacent to said side wall of said heating chamber, said mechanical chamber having a bottom wall with an air suction port therein at a lower part thereof;

a magnetron provided in said mechanical chamber for radiating microwave energy to material to be heated in said heating chamber;

a high frequency power supply adapted to supply microwave electric power to said magnetron, said high frequency power supply being positioned in proximity to and parallel with said magnetron and positioned perpendicular to said side wall of said heating chamber in said mechanical chamber, and said high frequency power supply comprising a power control semiconductor device and a high voltage transformer;

an air feeding device provided in the lower part of said mechanical chamber adapted to form a cooling air flow through said air suction port for cooling said magnetron and said high frequency power supply, said air feeding device comprising a propeller fan driven by a motor, and said propeller fan having a vertical axis of rotation and a direction of rotation;

a control adapted to control said magnetron and said high frequency power supply;

wherein said power control semiconductor device and said high-voltage transformer are disposed in proximity to said air feeding device in the cooling air flow, said power control semiconductor device being positioned first, before said high-voltage transformer, in the direction of rotation of said propeller;

a first frame in said mechanical chamber having a casing member in which said air feeding device is securely fixed and a first guide wall;

a second frame on which said high frequency power supply is disposed and having a second guide wall;

wherein said first and second frames are connected together at a connecting portion and fixed in an approximate L shape, and wherein said first and second guide walls define an airflow path for the cooling air flow for cooling said high frequency power supply; and wherein said first guide wall comprises an extension of said casing member of said first frame, and has a height approximately equal to the level of said power control semiconductor device and said high-voltage transformer, said first guide wall having a top portion in proximity to a cooling path of said magnetron, and wherein said second guide wall is in proximity to said first guide wall so as to surround said power control semiconductor device and said high-voltage transformer.

3. A microwave heating device, comprising:

a heating chamber having a side wall;

a mechanical chamber adjacent to said side wall of said heating chamber, said mechanical chamber having a bottom wall with an air suction port therein at a lower part thereof;

a magnetron provided in said mechanical chamber for radiating microwave energy to material to be heated in said heating chamber;

a high frequency power supply adapted to supply microwave electric power to said magnetron, said high frequency power supply being positioned in proximity to and parallel with said magnetron and positioned perpendicular to said side wall of said heating chamber in said mechanical chamber, and said high frequency power supply comprising a power control semiconductor device and a high voltage transformer;

an air feeding device provided in the lower part of said mechanical chamber adapted to form a cooling air flow through said air suction port for cooling said magnetron and said high frequency power supply, said air feeding device comprising a propeller fan driven by a motor, and said propeller fan having a vertical axis of rotation and a direction of rotation;

a control adapted to control said magnetron and said high frequency power supply;

a first frame in said mechanical chamber having a casing member in which said air feeding device is securely fixed and a first guide wall;

a second frame on which said high frequency power supply is disposed and having a second guide wall;

wherein said power control semiconductor device and said high-voltage transformer are disposed in proximity to said air feeding device in the cooling air flow, said power control semiconductor device being positioned first, before said high-voltage transformer, in the direction of rotation of said propeller;

wherein said first and second frames are connected together at a connecting portion and fixed in an approximate L shape, and wherein said first and second guide walls define an airflow path for the cooling air flow for cooling said high frequency power supply; and at least one communicating hole in said first frame in proximity to said connecting portion for generating an air flow circulating therethrough for cooling parts of said high frequency power supply disposed in proximity to said connecting portion; and wherein said first guide wall comprises an extension of said casing member of said first frame, and has a height approximately equal to the level of said power control semiconductor device and said high-voltage transformer, said first guide wall having a top portion in proximity to a cooling path of said magnetron, and wherein said second guide wall is in proximity to said first guide wall so as to surround said power control semiconductor device and said high-voltage transformer.

4. The microwave heating device of claim 3, wherein said first and second frames are one piece with each other and said connecting portion, said connecting portion comprising a portion between said first and second frames that is thinner than said first and second frames.

5. The microwave heating device of claim 3, wherein said control comprises means for driving said propeller fan at a first specified number of rotations per minute during an operation of said high frequency power supply and said magnetron and, after the operation of said high frequency power supply and said magnetron has stopped, driving said propeller fan for a specified period of time at a second specified number of rotations per minute lower than said first specified number of rotations per minute.

* * * * *